US006890479B2

(12) United States Patent
Manasek et al.

(10) Patent No.: US 6,890,479 B2
(45) Date of Patent: May 10, 2005

(54) SYSTEM AND METHOD FOR STEEL MAKING

(75) Inventors: Richard J. Manasek, Greenwood, IN (US); David P. Kincheloe, Greenwood, IN (US)

(73) Assignee: Amerifab, Inc., Indianapolis, IN (US)

( * ) Notice: Subject to any disclaimer, the term of this patent is extended or adjusted under 35 U.S.C. 154(b) by 205 days.

(21) Appl. No.: 10/238,971

(22) Filed: Sep. 11, 2002

(65) Prior Publication Data

US 2003/0053514 A1 Mar. 20, 2003

Related U.S. Application Data

(60) Provisional application No. 60/323,265, filed on Sep. 19, 2001.

(51) Int. Cl.[7] ..... C21B 7/16

(52) U.S. Cl. ..... 266/47; 266/194; 266/241

(58) Field of Search ..... 266/193, 194, 266/241, 47; 420/471

(56) References Cited

U.S. PATENT DOCUMENTS

| | | | | |
|---|---|---|---|---|
| 2,829,972 A | * | 4/1958 | Klement | 420/471 |
| 3,725,056 A | * | 4/1973 | Ingerson | 420/471 |
| 3,849,587 A | | 11/1974 | Hatch et al. | |
| 4,192,258 A | | 3/1980 | Touze | |
| 4,207,060 A | | 6/1980 | Zangs | |
| 5,241,559 A | | 8/1993 | Hixenbaugh | |
| 6,059,028 A | | 5/2000 | Kincheloe et al. | |
| 6,563,855 B1 | | 5/2003 | Nishi et al. | |

OTHER PUBLICATIONS

Metals Handbook, 8th Edition, vol. 1—Properties and Selection of Metals Published by American Society For Metals—pp. 960–990, p. 1002, pp. 1033–1037, no date.

* cited by examiner

*Primary Examiner*—Scott Kastler
(74) *Attorney, Agent, or Firm*—Barnes & Thornburg LLP

(57) ABSTRACT

A metallurgical furnace, which includes a furnace shell, an exhaust system, and a gas cleaning system, further includes a plurality of improved pipes and fume ducts throughout to increase operational life and productivity. The pipes and fumes ducts are comprised of an aluminum-bronze alloy which provides enhanced properties over prior art materials including thermal conductivity, modulous of elasticity and hardness. The use of the alloy also minimizes maintenance requirements of the pipes and fume ducts, thereby extending their operational life. In operation, gases formed from smelting or refining are evacuated from the furnace shell through the exhaust system into the gas cleaning system. The gases, as well as the system, are water cooled by way of the plurality of pipes displaced throughout.

20 Claims, 2 Drawing Sheets

SYSTEM AND METHOD FOR STEEL MAKING

CROSS REFERENCE TO RELATED APPLICATION

This application claims the benefit of U.S. Provisional Application No. 60/323,265, filed Sep. 19, 2001.

FIELD OF THE INVENTION

The present invention relates to a method and apparatus for metallurgical processing, particularly steel making. More particularly, the invention relates to a metallurgical furnace comprising, in part, an aluminum-bronze type alloy wherein the alloy is formed into piping which is mounted to the walls, roof, duct work and the off-gas system of the furnace for cooling the same, thereby extending the operational life of the furnace.

BACKGROUND OF THE INVENTION

Today, steel is made by melting and refining iron and steel scrap in a metallurgical furnace. Typically, the furnace is an electric arc furnace (EAF) or basic oxygen furnace (BOF). With respect to the EAF furnaces, the furnace is considered by those skilled in the art of steel production to be the single most critical apparatus in a steel mill or foundry. Consequently, it is of vital importance that each EAF remain operational for as long as possible.

Structural damage caused during the charging process affects the operation of an EAF. Since scrap has a lower effective density than molten steel, the EAF must have sufficient volume to accommodate the scrap and still produce the desired amount of steel. As the scrap melts it forms a hot metal bath in the hearth or smelting area in the lower portion of the furnace. As the volume of steel in the furnace is reduced, however, the free volume in the EAF increases. The portion of the furnace above the hearth or smelting area must be protected against the high internal temperatures of the furnace. The vessel wall, cover or roof, duct work and off-gas chamber are particularly at risk from massive thermal, chemical, and mechanical stresses caused by charging and melting the scrap and refining the resulting steel. Such stresses greatly limit the operational life of the furnace.

Historically, the EAF was generally designed and fabricated as a welded steel structure which was protected against the high temperatures of the furnace by a refractory lining. In the late 1970's and early 1980's, the steel industry began to combat operational stresses by replacing expensive refractory brick with water-cooled roof panels and water-cooled sidewall panels located in portions of the furnace vessel above the smelting area. Water-cooled components have also been used to line furnace duct work in the off-gas systems. Existing water-cooled components are made with various grades and types of plates and pipes. An example of a cooling system is disclosed in U.S. Pat. No. 4,207,060 which uses a series of cooling coils. Generally, the coils are formed from adjacent pipe sections with a curved end cap which forms a path for a liquid coolant flowing through the coils. This coolant is forced through the pipes under pressure to maximize heat transfer. Current art uses carbon steel and stainless steel to form the plates and pipes.

In addition, today's modern EAF furnaces require pollution control to capture the off-gases that are created during the process of making steel. Fumes from the furnace are generally captured in two ways. Both of these processes are employed during the operation of the furnace. One form of capturing the off-gases is through a furnace canopy. The canopy is similar to an oven hood. It is part of the building and catches gases during charging and tapping. The canopy also catches fugitive emissions that may occur during the melting process. Typically, the canopy is connected to a bag house through a non-water cooled duct. The bag house is comprised of filter bags and several fans that push or pull air and off-gases through the filter bags to cleanse the air and gas of any pollutants.

The second manner of capturing the off-gas emissions is through the primary furnace line. During the melting cycle of the furnace, a damper closes the duct to the canopy and opens a duct in the primary line. This is a direct connection to the furnace and is the main method of capturing the emissions of the furnace. The primary line is also used to control the pressure of the furnace. This line is made up of water cooled duct work as temperatures can reach 4000° F. and then drop to ambient in a few seconds. The gas streams generally include various chemical elements including hydrochloric and sulfuric acids. There are also many solids and sand type particles. The velocity of the gas stream can be upwards of 150 ft./sec. These gases will be directed to the main bag house for cleansing as hereinabove described.

The above-described environments place a high level of strain on the water cooled components of the primary ducts of the EAF furnace. The variable temperature ranges cause expansion and contraction issues in the components which lead to material failure. Moreover, the dust particles continuously erode the surface of the pipe in a manner similar to sand blasting. Acids flowing through the system also increase the attack on the material, additionally decreasing the overall lifespan.

Concerning BOF systems, improvements in BOF refractories and steelmaking methods have extended operational life. However, the operational life is limited by, and related to, the durability of the off-gas system components, particularly the duct work of the off-gas system. With respect to this system, when failure occurs, the system must be shut down for repair to prevent the release of gas and fumes into the atmosphere. Current failure rates cause an average furnace shut down of 14 days. As with EAF type furnaces, components have historically been comprised of water-cooled carbon steel or stainless steel type panels.

Using water-cooled components in either EAF or BOF type furnaces has reduced refractory costs and has also enabled steelmakers to operate each furnace for a greater number of heats then was possible without such components. Furthermore, water-cooled equipment has enabled the furnaces to operate at increased levels of power. Consequently, production has increased and furnace availability has become increasingly important. Notwithstanding the benefits of water-cooled components, these components have consistent problems with wear, corrosion, erosion and other damage. Another problem associated with furnaces is that as available scrap to the furnace has been reduced in quality, more acidic gases are created. This is generally the result of a higher concentration of plastics in the scrap. These acidic gases must be evacuated from the furnace to a gas cleaning system so that they may be released into the atmosphere. These gases are directed to the off-gas chamber, or gas cleaning system, by a plurality of fume ducts containing water cooled pipes. However, over time, the water cooled components and the fume ducts give way to acid attack, metal fatigue or erosion. Certain materials (i.e., carbon steel and stainless steel) have been utilized in an attempt to resolve the issue of the acid attack. More water and higher water temperatures have been used with carbon steel in an attempt to reduce water concentration in the scrap and reduce the risk of acidic dust sticking to the side walls of a furnace. The use of such carbon steel in this manner has proven to be ineffective.

Stainless steel has also been tried in various grades. While stainless steel is less prone to acidic attack, it does not possess the heat transfer characteristics of carbon steel. The result obtained was an elevated off-gas temperature and built up mechanical stresses that caused certain parts to fracture and break apart.

Critical breakdowns of one or more of the components commonly occurs in existing systems due to the problems set forth above. When such a breakdown occurs, the furnace must be taken out of production for unscheduled maintenance to repair the damaged water-cooled components. Since molten steel is not being produced by the steel mill during downtime, opportunity losses of as much as five thousand dollars per minute for the production of certain types of steel can occur. In addition to decreased production, unscheduled interruptions significantly increase operating and maintenance expenses.

In addition to the water cooled components, corrosion and erosion is becoming a serious problem with the fume ducts and off gas systems of both EAF and BOF systems. Damage to these areas of the furnace results in loss of productivity and additional maintenance costs for mill operators. Further, water leaks increase the humidity in the off-gases and reduce the efficiency of the bag house as the bags become wet and clogged. The accelerated erosion of these areas used to discharge furnace off-gases is due to elevated temperatures and gas velocities caused by increased energy in the furnace. The higher gas velocities are due to greater efforts to evacuate all of the fumes for compliance with air emissions regulations. The corrosion of the fume ducts is due to acid formulation/attack on the inside of the duct caused by the meetings of various materials in the furnaces. The prior art currently teaches of the use of fume duct equipment and other components made of carbon steel or stainless steel. For the same reasons as stated above, these materials have proven to provide unsatisfactory and inefficient results.

A need, therefore, exists for an improved water-cooled furnace panel system and method for making steel. Specifically, a need exists for an improved method and system wherein water cooled components and fume ducts remain operable longer than existing comparable components.

SUMMARY OF THE INVENTION

The present method and system utilizes a heavy-walled type pipe comprised of an Aluminum-Bronze alloy used in a cooling panel, the panels being used in both EAF and BOF type furnaces. In an EAF, an array of pipes are aligned along the inside wall above the hearth thereby forming a cooling surface between the interior and the wall of the furnace. Generally, the EAF has a furnace shell, a plurality of electrodes, an exhaust system and off gas chamber that utilizes the aluminum-bronze alloy ("alloy"), which is custom melted and processed into a seamless pipe. The EAF system also utilizes fume ducts composed of the same material. In an alternative BOF system, a similar piping array forms an assemblage of panels used to line the furnace hood and off gas chamber. The aluminum-bronze alloy has superior thermal conductivity, hardness and modulus of elasticity over the prior art materials used. Thus, the operational life of the furnace is extended and corrosion and erosion of the water cooled components and the fume ducts is reduced.

OBJECTS OF THE INVENTION

The principal object of the present invention is to provide an improved method and system for steel-making with a furnace wherein water cooled components remain operable longer than existing comparable components. Thus, the present invention is directed to a heavy-walled, aluminum bronze alloy pipe for use in a cooling panel in a metallurgical furnace.

According to another object of the present invention, a method is provided for cooling the interior walls of a metallurgical furnace. The method includes providing a plurality of cooling panels having a plurality of extruded pipes or cast comprised of an aluminum-bronze alloy. The pipes have a generally tubular section and a base section. The method further includes the steps of attaching the cooling panels to the interior of the furnace and running water through the pipes thereby cooling the furnace.

Another object of the invention is to provide an improved furnace with extruded seamless piping and duct work which better resists corrosion, erosion, pressure, and thermal stress.

A further object of this invention is to provide an improved method and system for steel making with a furnace wherein maintenance costs are reduced and production is increased.

BRIEF DESCRIPTION OF THE DRAWINGS

The foregoing and other objects will become more readily apparent by referring to the following detailed description and the appended drawing in which.

DETAILED DESCRIPTION

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting.

Figure 1:
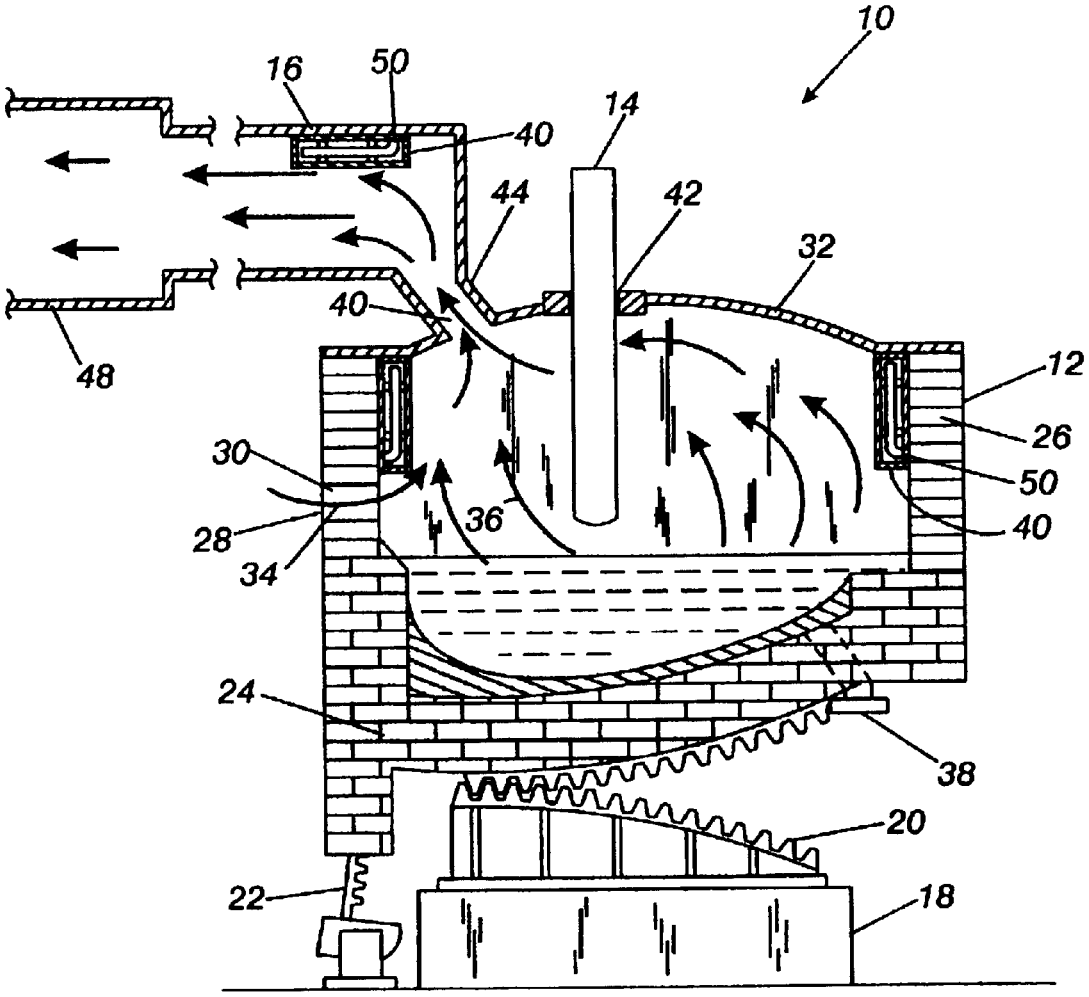
FIG. 1 is a sectional view of a typical EAF used in the steel making industry wherein the cooling panels comprising an array of pipes is provided, said pipes being made of an aluminum-bronze alloy.

Referring to FIG. 1, the present invention is shown in an EAF type furnace. It is to be understood that the EAF disclosed is for explanation only and that the invention can be readily applied in BOF type furnaces and the like. In FIG. 1, an EAF 10 includes a furnace shell 12, a plurality of electrodes 14, an exhaust system 16, a working platform 18, a rocker tilting mechanism 20, a tilt cylinder 22 and an off gas chamber 48. The furnace shell 12 is movably disposed upon the rocker tilt 20 or other tilting mechanism. Further, the rocker tilt 20 is powered by tilt cylinder 22. The rocker tilt 20 is further secured upon the working platform 18.

The furnace shell 12 is comprised of a dished hearth 24, a generally cylindrical side wall 26, a spout 28, a spout door 30 and a general cylindrical circular roof 32. The spout 28 and spout door 30 are located on one side of the cylindrical side wall 26. In the open position, the spout 28 allows intruding air 34 to enter the hearth 24 and partially burn gases 36 produced from smelting. The hearth 24 is formed of suitable refractory material which is known in the art. At one end of the hearth 24 is a pouring box having a tap means 38 at its lower end. During a melting operation, the tap means 38 is closed by a refractory plug or a slidable gate. Thereafter, the furnace shell 12 is tilted, the tap means 38 is unplugged or open and molten metal is poured into a teeming ladle, tundish, or other device, as desired.

The side wall 26 of the furnace shell 12 consists of water-cooled side wall panels 40 which produce a more efficient operation and prolong the operation life of EAF 10. In a preferred embodiment, the panels 40 are comprised of an array of pipes 50 and are understood to include an inner metallic wall cooled by spray nozzles 52. However, those skilled in the art will appreciate that the panels 40 may take any conventional form, since the details thereof form no part of the present invention other than the pipes comprising the same. In any event, the upper ends of the panels 40 define a circular rim at the upper margin of the side wall 26 portion.

The roof 32 is water cooled by additional piping 50 and includes a cylindrical skirt portion located at the upper end of the upper side wall 26 section and forming an extension thereof. In particular, the lower margin of the skirt portion is complementary to and abuts the circular rim of the wall section. Also forming a part of the roof 32 is an annular section whose outer periphery is complementary to the upper end of the skirt portion. Disposed within the annular section is a central section having a circular outer periphery which is complementary to and abuts the edge of the opening defined by the annular section. Also forming part of the roof 32 is a plurality of perforations 42 centrally located thereon for inserting of one or more electrodes therethrough.

Those skilled in the art will appreciate that the number of electrodes 14 in any particular furnace is determined by the metallurgical process to be performed and the nature of the energy source. However, in a preferred embodiment of this invention, the number of electrodes 14 is three. The electrodes 14 are vertically disposed through the perforations 42 of the roof 32 and extend downward into the hearth 24. The general direction of the movement of the electrodes 14 is normally downwardly as their lower ends are consumed or broken away.

The exhaust system 16 generally comprises a plurality of fume ducts 44 and panels 40 made of the piping 50 and which lead from a vent 46 in the furnace shell 12 to off gas chamber 48. Those skilled in the art will appreciate that any exhaust system 16 utilizing water cooled components can be employed as the system's details form no part of the present invention. However, in a preferred embodiment of the invention, a "fourth hole" direct furnace shell evacuation system ("DES") is used. The term fourth hole refers to an additional hole, the vent 46, other than the perforations 42 for the electrodes 14, which vent is provided for off gas extraction.

In operation, hot waste gases 36, dust and fumes are removed from the hearth 24 through vent 46 in the furnace shell 12 to a gas cleaning system (i.e., the off gas chamber 48) for filtering before discharge into the atmosphere. The vent 46 communicates with the exhaust system 16 comprised of the fume ducts 44 and piping 50, which is connected to the off-gas chamber 48.

Figure 2:
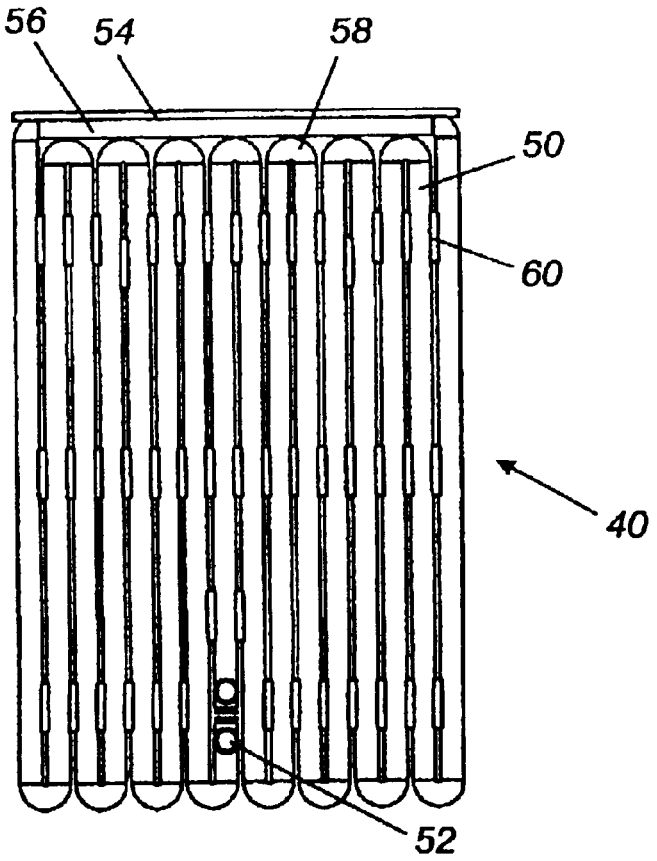
FIG. 2 shows a front view of an array of pipes according to the present invention connected to a cooling panel.

As shown in FIG. 2, a panel 40 has an inner surface or face that is exposed to a furnace interior. In one embodiment, nozzles 52 are positioned on the panel 40 for introducing and/or removing fluid from the piping 50. A flange 54 is attached to an upper region 56 of the panel 40 for connecting the panel 40 to a furnace shell.

The panel 40 is a pipe embodiment having multiple axially arranged pipes 50. U-shaped elbows 58 connect adjacent pipes 50 together to form a continuous pipe system. Spacers 60 may optionally be provided between adjacent pipes 50 to provide structural integrity of the panel 40.

Figure 3:
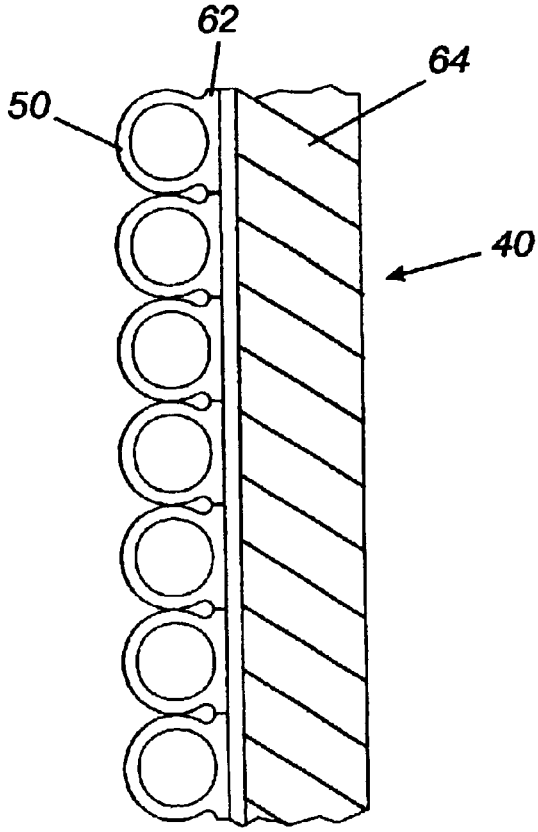
FIG. 3 is a cross-sectional view of an array of pipes according to the present invention connected to a cooling panel.

FIG. 3 is a cross-sectional view of the panel embodiment of FIG. 2. An array of pipes 50 having a tubular cross-section and a base section. The pipe 50 is attached to a panel back 64 thereby forming the panel 40 and positioned between and interior and a wall of a furnace. The pipes 50 are used to cool the wall of the furnace above the hearth in an EAF or the hood and fume ducts of a BOF.

As further shown in FIG. 3 embodiment, the pipe 50 includes a tubular section and base section 62. The tubular section is hollow for conveying water or other cooling fluids. The base section 62 has a planer bottom for connection to the panel 40. The base section 62 is provided with protruding ends which preferably extend the distance of the outer diameter of the pipe 50 to contact the base section 62 of an adjacent pipe 50. Alternatively, the protruding ends can extend more than, or less than, the outer diameter of the pipe 50. The base section 62 additionally acts as a seal bar to ease the manufacturing process.

As further shown by FIG. 3, the plurality of pipes 50 are connected to the panel 40. The pipes 50 are parallel to each other and preferably arranged so that the base section 62 of each pipe 50 abuts the base section 62 of an adjacent pipe 50. The pipes 50 are connected in serpentine fashion (shown in FIG. 2), that is, the elbow connects each pipe 50 to the succeeding pipe 50. It is to be understood that the panel 40 of pipes 50 can be arranged in a horizontal fashion or in a vertical fashion. Further, the pipes 50 can be linear, or, the pipes 50 can curve to follow the interior contour of the furnace wall.

The ducts 44 and piping 50 of the water cooled components are comprised of an aluminum-bronze alloy custom melted and processed into a seamless pipe 50. Thereafter, the ducts 44 are formed and incorporated into the exhaust system 16. Moreover, the piping 50 is formed into the cooling panels 40 and placed throughout the roof 32 and ducts 44. The aluminum-bronze alloy preferably has a nominal composition of: 6.5% Al, 2.5% Fe, 0.25% Sn, 0.5% max Other, and Cu equaling the balance. However, it will be appreciated that the composition may vary so that the Al content is at least 5% and no more than 11% with the respective remainder comprising the bronze compound.

The use of the Aluminum-bronze alloy provides enhanced mechanical and physical properties over prior art devices (i.e., carbon or stainless steel cooling systems) in that the alloy provides superior thermal conductivity, hardness, and modulous of elasticity for the purposes of steel making in a furnace. By employing these enhancements, the operational life of the furnace is directly increased. The properties of the alloy of the preferred embodiment of the invention is shown in Table 1 in conjunction with various thicknesses.

| Mechanical and physical properties | Units | ≦12.7 mm ø | 12.7–25.4 mm ø | 25.4–50.8 mm ø | 50.8–76.2 mm ø |
|---|---|---|---|---|---|
| 1) Tensile strength Rm | MPa | 586 (552) | 565 (517) | 552 (496) | 517 (485) |
| 2) Yield strength Rp 0, 2 | MPa | 386 (352) | 358 (317) | 323 (288) | 283 (248) |
| 3) Elongation A5 | % | 35 (30) | 35 (30) | 35 (30) | 35 (30) |
| 4) Brinell hardness | HB 30 | 187 | 183 | 174 | 163 |
| 5) Rockwell hardness | HRB | 91 | 90 | 88 | 85 |
| 6) Reduction of area ψ | % | 55 | 55 | 60 | 63 |
| 7) Compressive strength Rmc | MPa | 931 | 896 | 862 | 827 |
| 8) Compressive strength, 0.1% perm. set | MPa | — | 324 | — | — |
| 9) Proportional limit in compression $R_{oc}$ | MPa | 179 | 165 | 152 | 138 |
| 10) Shear strength $R_{cm}$ | MPa | 331 | 310 | 276 | 276 |
| 11) Modulus of elasticity E | GPa | 124 | 124 | 124 | 124 |
| 12a) $Charpy_{ak}$ | J | 41 | 47 | 54 | 54 |
| 12b) $Izod_{ak}$ | J | 61 | 68 | 75 | 75 |
| 13) Density ρ | $g/cm^3$ | 7.95 | | | |
| 14) Coefficient of expansion α | $10^{-6}/K$ | 16.3 | | | |
| 15) Thermal conductivity λ | W/m · K | 54 | | | |
| 16a) Electrical conductivity γ | $m/\Omega \cdot mm^2$ | 7 | | | |
| 16b) Electrical conductivity I.A.C.S | % | 12 | | | |
| 17) Specific heat C. ° | J/g · K | 0.42 | | | |

In addition to the superior heat transfer characteristics, the elongation capabilities of the alloy is greater than that of steel or stainless steel thereby allowing the piping and duct work 44 to expand and contract without cracking. Still further, the surface hardness is superior over the prior art in that it reduces the effects of erosion from the blasting effect of off-gas debris.

The process of forming the piping and fume ducts 44 is preferably extrusion, however, one skilled in the art will appreciate that other forming techniques may be employed which yield the same result, i.e., a seamless component. During extrusion, the aluminum-bronze alloy is hot worked thereby resulting in a compact grain structure which possesses improved physical properties. Further, a preferred embodiment of this invention utilizes piping and fume ducts 44 wherein the mass on each side of the center line of the tubular section is equivalent so that stress risers are not created during manufacture. Since relatively uniform temperature in stress characteristics are maintained within the piping or ducts 44, the component is less subject to damage caused by dramatic temperature changes encountered during the cycling of the furnace.

The composition of the piping and ducts 44 differs from the prior art in that piping and ducts 44 in the prior art were composed of carbon-steel or stainless steel. The composition of the alloy is not as prone to acid attack. In addition, a higher heat transfer rate exists over both carbon-steel or stainless steel. One of the properties which makes the alloy better than the stainless steel is that the alloy possesses the capability to expand and contract without cracking. Finally, the surface hardness of the alloy is greater than that of either steel thereby reducing the effects of eroding the surface from the blasting effects of the off-gas debris.

In operation, extruded pipes 50 are attached to the panel 40. The panel 40 is hung within a furnace or off-gas system. Circulating fluid provided to the pipes 50 feeds through each pipe 50 in serpentine fashion, thereby cooling the system. Upon failure of a pipe 50, the panel 40 of pipes 50 can be removed for repair and replaced by a new panel 40 of pipes 50.

Although particular embodiments of the invention have been described in detail, it will be understood that the invention is not limited correspondingly in scope, but includes all changes and modifications coming within the spirit and terms of the claims appended hereto.

SUMMARY OF THE ACHIEVEMENT OF THE OBJECTS OF THE INVENTION

From the foregoing, it is readily apparent that we have invented an improved method and system for steel making wherein the operational life of a metallurgical furnace is extended.

It is further apparent that we have invented an improved method and system for steel making with a furnace by using extruded seamless piping and duct work which better resists corrosion and erosion.

It is further apparent that we have invented an improved method and system for steel making with a furnace wherein water cooled components remain operable longer than existing comparable components.

It is further apparent that we have invented an improved method and system for steel making with a furnace wherein maintenance costs are reduced and production is increased.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed:

1. A metallurgical furnace comprising:

a furnace shell having a hearth, a side wall above said hearth, and a roof at the top thereof;

a heating means for heating the interior of the shell to temperatures in the range of about 2000° F. to 4000° F.;

an exhaust system attached to said furnace shell, said system having an opening and at least one fume duct;

an off gas chamber connected to said furnace shell by said fume duct of said exhaust system; and a plurality of pipes, plates or a combination thereof disposed throughout the furnace shell and the exhaust system for cooling the furnace during operation, wherein said fume duct and said plurality of pipes are comprised at least of an aluminum-bronze alloy, where the alloy has iron and tin having a combined weight percent that is at least 2.5% of the total weight of the alloy.

2. The metallurgical furnace of claim 1 wherein the aluminum-bronze alloy comprises at least about 89% copper and no more than about 95% copper.

3. The metallurgical furnace of claim 1 wherein said off-gas chamber further comprises a series of water cooled panels secured to the interior side of the side wall.

4. The metallurgical furnace of claim 1 wherein said plurality of pipes and said plurality of fume ducts are each formed by extrusion into seamless components.

5. A method of extending the operational life of a metallurgical furnace, comprising the steps of:

providing a plurality of pipes thereby forming a cooling panel and a plurality of fumes ducts, said plurality of pipes and said plurality of fume ducts being formed at least partially of an aluminum-bronze alloy, where the alloy has iron and tin having a combined weight percent that is at least 2.5% of the total weight of the alloy;

attaching said cooling panel and said plurality of fume ducts to the interior of the furnace;

cooling the furnace from temperatures in the range of about 2000° F. to 4000° F. by running fluid through said plurality of pipes during an operational phase of the furnace; and evacuating gases from the furnace shell through the plurality of fume ducts during the operational phase of the furnace.

6. The method according to claim 5 wherein the aluminum-bronze alloy comprises at least about 89% copper and no more than about 95% copper.

7. The method according to claim 5 wherein the furnace is provided with a furnace shell, an exhaust system, and a gas cleaning system.

8. The method according to claim 7 wherein the furnace shell is further provided with a dished hearth, a generally cylindrical side wall, and a generally circular roof.

9. The method of claim 7 wherein the gas cleaning system is provided with a series of water cooled panels secured therein.

10. A furnace wall structure for a metallurgical furnace wherein a cooling panel comprised of a plurality of pipes made at least partially of an aluminum-bronze alloy, where the alloy has iron and tin having a combined weight percent that is at least 2.5% of the total weight of the alloy, and where the plurality of pipes is provided on the interior of the furnace for cooling the same from temperatures in the range of about 2000° F. to 4000° F.

11. The furnace wall structure of claim 10 wherein said alloy comprises at least 5% Al and no more than 11% Al.

12. The furnace wall structure of claim 10 wherein said alloy comprises at least 89% copper and no more than 95% copper.

13. A method of extending the operational life of an off-gas system used in steel making, comprising the steps of:

providing a plurality of pipes and a plurality of fumes ducts, said plurality of pipes and said plurality of fume ducts being formed at least partially of an aluminum-bronze alloy, where the alloy has iron and tin having a combined weight percent that is at least 2.5% of the total weight of the alloy;

attaching said plurality of pipes and said plurality of fume ducts to the interior wall structure of the off-gas system; and cooling the off-gas system from temperatures in the range of about 2000° F. to 4000° F. by running fluid through said plurality of pipes during an operational phase of the off-gas system.

14. The off-gas system according to claim 13 wherein the aluminum-bronze alloy comprises at least about 89% copper and no more than about 95% copper.

15. The off-gas system wall structure of claim 13 wherein said alloy comprises at least 5% Al and no more than 11% Al.

16. The off-gas system wall structure of claim 13 wherein said alloy comprises at least 89% copper and no more than 95% copper.

17. A cooling panel for an electric arc furnace operating at temperatures in excess of 2000° F., comprising:

a back panel;

a plurality of hollow pipes formed in a serpentine channel through which a coolant is flowably attached to said back panel; and wherein said plurality of hollow pipes is comprised at least partially of an aluminum-bronze alloy, where the alloy has iron and tin having a combined weight percent that is at least 2.5% of the total weight of the alloy.

18. The cooling panel according to claim 17 wherein the aluminum-bronze alloy comprises at least about 89% copper and no more than about 95% copper.

19. The cooling panel wall structure of claim 17 wherein said alloy comprises at least 5% Al and no more than 11% Al.

20. The cooling panel wall structure of claim 17 wherein said alloy comprises at least 89% copper and no more than 95% copper.

* * * * *